US008054157B2

(12) United States Patent
Weiss

(10) Patent No.: US 8,054,157 B2
(45) Date of Patent: Nov. 8, 2011

(54) RF TERMINATING RESISTOR OF FLANGED CONSTRUCTION

(75) Inventor: Frank Weiss, Bernsdorf (DE)

(73) Assignee: Rosenberger Hochfrequenztechnik GmbH & Co., KG, Fridolfing (DE)

( * ) Notice: Subject to any disclaimer, the term of this patent is extended or adjusted under 35 U.S.C. 154(b) by 303 days.

(21) Appl. No.: 12/516,986

(22) PCT Filed: Nov. 7, 2007

(86) PCT No.: PCT/EP2007/009645

§ 371 (c)(1),
(2), (4) Date: May 29, 2009

(87) PCT Pub. No.: WO2008/071271

PCT Pub. Date: Jun. 19, 2008

(65) Prior Publication Data

US 2010/0066483 A1 Mar. 18, 2010

(30) Foreign Application Priority Data

Dec. 12, 2006 (DE) ..... 20 2006 018 768 U

(51) Int. Cl.
*H01C 7/00* (2006.01)

(52) U.S. Cl. ..... 338/13; 338/59; 338/159; 338/314

(58) Field of Classification Search ..... 338/11, 338/13, 23, 59, 159

See application file for complete search history.

(56) References Cited

U.S. PATENT DOCUMENTS

| | | | | |
|---|---|---|---|---|
| 5,896,264 | A * | 4/1999 | Bijlenga et al. | 361/106 |
| 6,794,981 | B2 * | 9/2004 | Padmanabhan et al. | 338/25 |
| 2010/0066483 | A1 * | 3/2010 | Weiss | 338/314 |

FOREIGN PATENT DOCUMENTS

| | | | |
|---|---|---|---|
| DE | 20 2005 013515 | U1 | 11/2005 |
| EP | 0424536 | A | 5/1991 |
| EP | 1460710 | A | 9/2004 |
| JP | 04 125903 | A | 4/1992 |
| JP | 11 186813 | A | 7/1999 |

* cited by examiner

*Primary Examiner* — James Harvey

(74) *Attorney, Agent, or Firm* — DeLio & Peterson LLC; Robert Curcio

(57) ABSTRACT

An RF terminating resistor with a flange body, a planar layer structure, an upper face of a substrate, a resistance layer, an input conductor track, and an earth connection conductor track. The input conductor track electrically connected to opposite ends of the resistance layer. The substrate having a contact face, facing away from the layer structure. The flange body being bent around in a direction parallel to a first edge facing the earth conductor track, and a predetermined section bent around in a direction at right angles to this edge. The bent-around section extending in a space between a first plane, defined by the contact face, and a second plane, defined by the upper face, with the substrate abutting on the bent-around section connecting the contact face to the upper face and facing the earth connection conductor track on the upper face.

18 Claims, 2 Drawing Sheets

RF TERMINATING RESISTOR OF FLANGED CONSTRUCTION

CROSS REFERENCED TO RELATED APPLICATION

This application is a National Phase filing of PCT/EP/2007/009645 filed Nov. 7, 2007, under 35 U.S.C. §371, and claims priority to German Application No. DE 20 2006 018 768.5 filed Dec. 12, 2006.

BACKGROUND OF THE INVENTION

1. Field of the Invention

The present invention relates to an RF terminating resistor with a flange body and a planar layered structure arranged thereon, which comprises, on an upper face of a substrate, a resistor layer for converting RF energy into heat, an input conductor track for supplying RF energy and an earth connection conductor track for electrical connection to an earth contact on the flange body, wherein the input conductor track is electrically connected to a first end of the resistor layer, the earth connection conductor track is electrically connected to a second end of the resistor layer opposing the first end and the substrate lies on the flange body with a contact face which faces away from the layered structure.

2. Description of Related Art

Broadband RF terminating resistors of flanged construction serve to conduct away large power losses. It is known to mount a resistor structure on a substrate and to arrange said substrate on a flange body which represents an earth contact. In order to create an electrical connection from the resistor structure to the earth contact of the flange body, it is necessary to build up an edge peripheral contact round the substrate or a substrate through contact to the earth connection. However, both are complex and costly.

SUMMARY OF THE INVENTION

It is an object of the invention to improve an RF terminating resistor of the aforementioned type with regard to its design and production and also not to worsen the electrical properties of the RF terminating resistor, but rather to improve them.

This aim is achieved according to the invention with an RF terminating resistor of the aforementioned type and having the characterizing features of claim 1. Advantageous embodiments of the invention are described in the other claims.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-6 of the drawings in which like numerals refer to like features of the invention.

In an RF terminating resistor of the aforementioned type, it is provided according to the invention that, at a first edge which faces toward the earth connection conductor track on the substrate, over at least one predetermined section in a direction parallel to said edge and a predetermined section in a direction perpendicular to said edge, the flange body is bent over such that the bent-over section of the flange body extends into a space between a first plane defined by the contact face of the substrate and a second plane defined by the upper face of the substrate, wherein, with one side which connects the contact face of the substrate to the upper face of the substrate and towards which the earth connection conductor track on the upper face of the substrate faces, the substrate abuts the bent-over section of the flange body.

This has the advantage that, in order to produce the electrical contact between the earth connection conductor track and the earth contact on the flange body, a costly edge peripheral contact round one side of the substrate is not necessary, but rather this electrical contact is arranged in the second plane of the upper side of the substrate on which the earth connection conductor track is arranged on the substrate, can be easily produced by electrically connecting the earth connection conductor track to the bent-over section of the flange body.

An electrical contact between the earth connection conductor track and the bent-over section of the flange body can be particularly easily achieved in that the bent-over section of the flange body rises from the first plane at least into the second plane or therebeyond, such that at least one section of the bent-over section of the flange body extends in the second plane adjacent to the earth connection conductor track.

Suitably, the bent-over section of the flange body has a length in a direction parallel to the first edge which corresponds to at least a width of the substrate.

In that the bent-over section of the flange body has at least two noses, the separation of which in the direction parallel to the first edge of the flange body corresponds to the width of the substrate, and which, starting from the elevation, extend into a space between the first plane and the second plane, a stop is provided on both sides for the substrate, fixing a position of the substrate on the flange body even before the fastening of the substrate onto the flange body.

Suitably, the bent-over section encloses an angle of 90° with the first plane on a side facing toward the substrate.

In order to ensure that the bent-over section touches the substrate, the bent-over section encloses an angle with the first plane on a side facing towards the substrate of less than 90°, in particular 86° to 80°.

Figure 2:
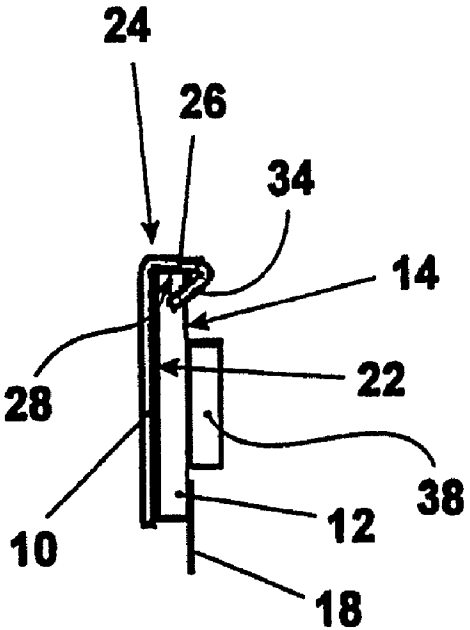
FIG. 2 shows the RF terminating resistor according to FIG. 1 in a side view.
Figure 1:
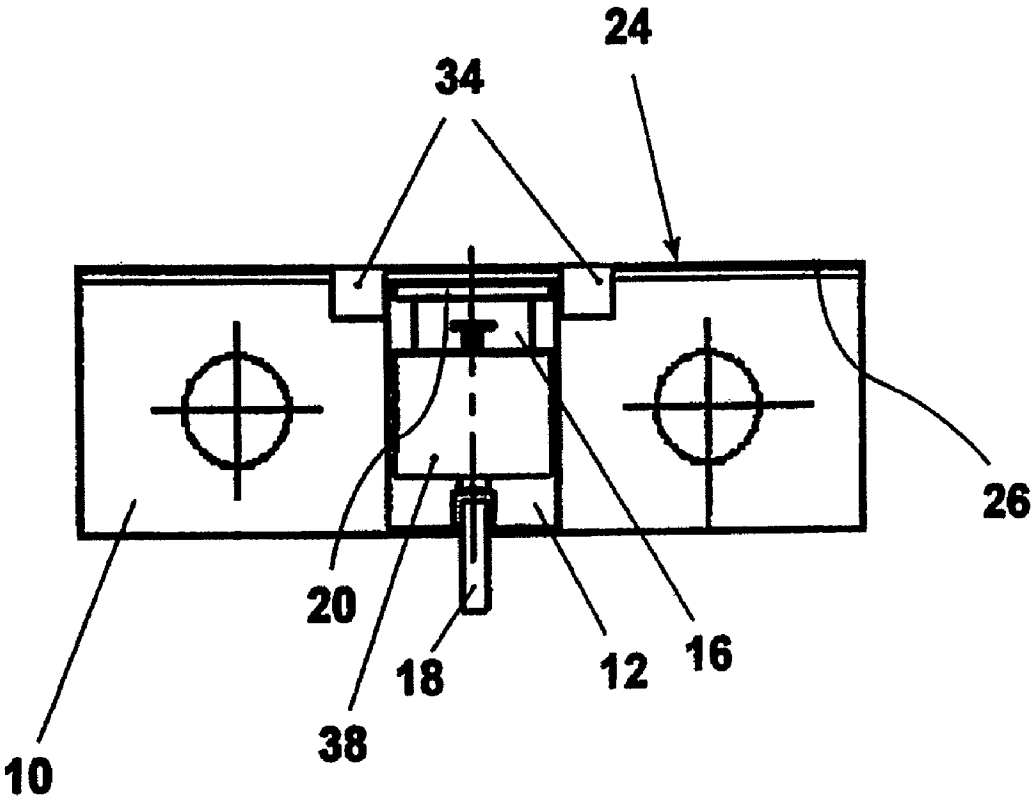
FIG. 1 shows a preferred embodiment of an RF terminating resistor according to the invention in a plan view.
Figure 3:
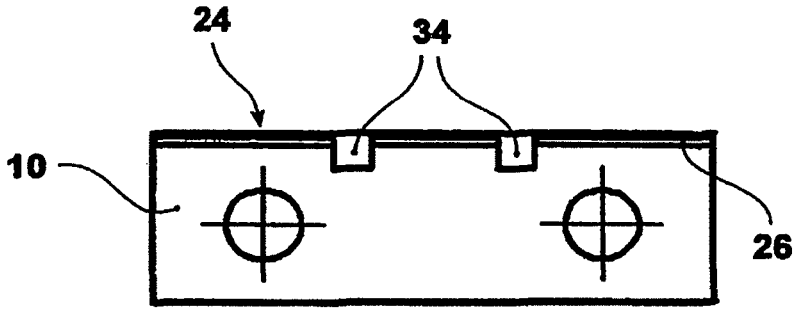
FIG. 3 shows a flange body for an RF terminating resistor according to the invention in a plan view.
Figure 4:
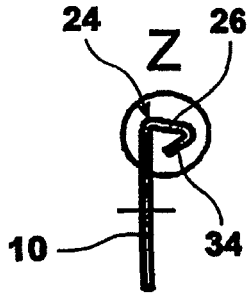
FIG. 4 shows the flange body of FIG. 3 in a side view.
Figure 5:
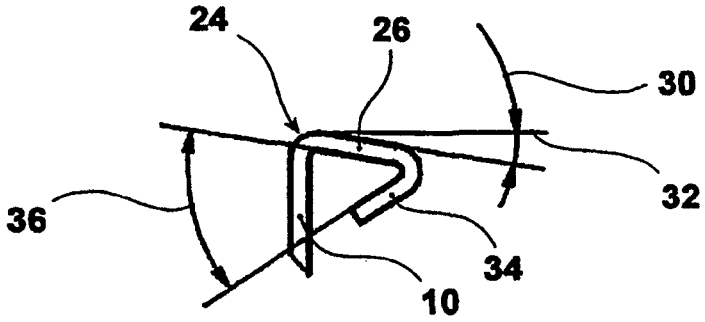
FIG. 5 shows the detail Z of FIG. 4.
Figure 6:
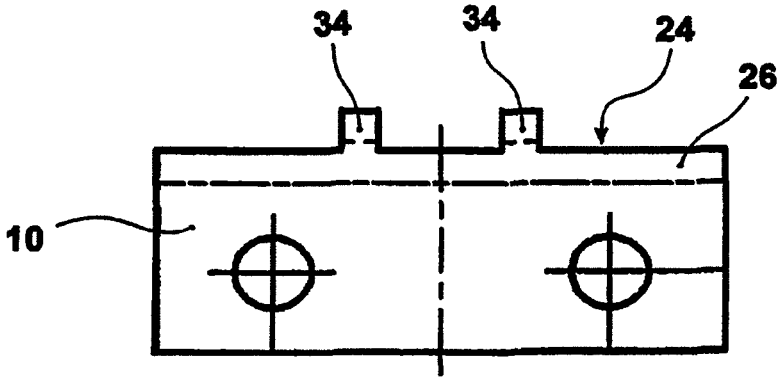
FIG. 6 shows the flange body of FIG. 3 in an unrolled representation.

The preferred embodiment of an RF terminating resistor of flange construction according to the invention shown in FIGS. 1 and 2 comprises a flange body 10 on which a substrate 12 is arranged. Arranged on an upper face 14 of the substrate 12 is a layered structure which comprises a resistor layer 16 for converting RF energy into heat, an input conductor track 18 for supplying RF energy and an earth connection conductor track 20 for electrical connection to an earth contact on the flange body 10. The input conductor track 18 is electrically connected to a first end of the resistor layer 16. The earth connection conductor track 20 is electrically connected to a second end of the resistor layer 16 opposing the first end. The substrate 12 lies with a contact face 22 which faces away from the layered structure 16, 18, 20 on the flange body 10.

The flange body 10 has an edge 24 wherein the substrate 12 is arranged with the layered structure 16, 18, 20 mounted thereon on the flange body 10 such that the earth connection conductor track 20 faces towards said edge 24.

The contact face 22 of the substrate 12 defines a first plane and the upper face 14 of the substrate 12 defines a second plane.

As shown also by FIGS. 3 to 6, over a predetermined section in a direction parallel to the edge 24 and over a predetermined section in a direction perpendicular to the edge 24, said edge 24 is bent over. In the exemplary embodiment shown in the figures, the predetermined section extends parallel to the edge 24 over the whole length of the edge 24. This predetermined section parallel to the edge 24 can alternatively extend over just part of the length of the edge 24, for example, over a length corresponding to the width of the substrate 12 in a direction parallel to the edge 24.

The bent-over section 26 of the flange body 10 is configured and bent over in such a way that the bent-over section 26 extends at least into the space between the first and second planes. In the exemplary embodiment shown, the bent-over section 26 extends completely through the space between the first and second planes as far as the second plane and further beyond the second plane. However, it is also possible for the bent-over section 26 to extend exactly as far as the second plane or to end within the space between the first and second planes.

The substrate 12 makes contact with a short face 28, which connects the upper face 14 of the substrate 12 to the contact face 22 of the substrate 12, on the bent-over section 26 of the flange body 10. The short face 28 is the face of the substrate 12 which faces towards the earth connection conductor track 20 on the upper face 14 of the substrate 12. In order to ensure this abutting of the short face 28 against the bent-over section 26 of the flange body 10 in any event, it is particularly advantageous if the bent-over section 26 of the flange body 10 is bent over by more than 90° relative to the flange body 10. This produces an angle between the bent-over section 26 of the flange body 10 and the upper face of the substrate 12 or between the bent-over section 26 and the plane defined by said upper face on a side facing towards the substrate 12 of less than 90°, for example 86° to 80°. Expressed otherwise, an angle 30 between the bent-over section 26 of the flange body 10 and a perpendicular 32 to the upper face 14 of the substrate 12 has a value in the range of 4° to 10°.

Also arranged on the bent-over section 26 of the flange body 10 are two noses 34 which extend beyond the end of the bent-over section 26 and are bent over relative to the bent-over section 26 by a further angle 36 of, for example 45°. These noses 34 therefore extend back into the space between the first and second planes. The spacing between these noses 34 in a direction parallel to the edge 24 of the flange body 10 corresponds approximately to the width of the substrate 12 in the direction parallel to the edge 24. By this means, the position of the substrate 12 on the flange body 10 and relative to the bent-over section 26 is fixed by positioning between the noses 34 and simplifies mounting of the substrate 12 on the flange body 10.

The bent-over section 26 of the flange body 10 forms the earth contact for the earth connection conductor track 20. In that the bent-over section 26 extends into the space between the first and second planes, electrical contact can easily be created between the earth connection conductor track 20 and the bent-over section 26 without complete edge peripheral contact round the short face 28 of the substrate 12. In the exemplary embodiment shown, the bent-over section 26 extends above the second plane or the upper face 14 of the substrate 12, so that the electrical contact between the earth connection conductor track 20 and the bent-over section 26 of the flange body 10 can be created directly in one plane, specifically the second plane of the upper face 14 of the substrate 12. This simplifies the creation of the electrical contact and, simultaneously, improves the electrical properties of the RF terminating resistor, since the path of the electrical contact is as short as possible and no longer leads completely round an edge of the substrate 12.

A covering 38 partially covers the layered structure 16, 18, 20. This covering is made, for example, from the same material as the substrate 12. The covering 38 therefore has the same dielectric constant as the material of the substrate 12. This also positively influences the electrical properties of the RF terminating resistor, since due to the dielectric (12, 38), that is, the substrate 12 on one side and the covering 38 on the other side, which is identical on both sides, the electric field is guided close to the layered structure 16, 18, 20.

Thanks to the improved design of the RF terminating resistor according to the invention, inexpensive substrates 12, that is substrates without an edge peripheral contact, can be used. The overall design of the flanged load ensures the transfer of large power losses whilst maintaining the best possible broadband RF properties.

The flange body or the flange sheet 10 with the bent-over section 26 is made entirely from one piece, for example, a press-bent part. The bent-over section 26 serves for the earth connection of the resistor structure 14 to the flange sheet 10. The overall construction including the substrate structure 12, 16, 18, 20 is intended for a broadband application with very good RF properties.

In order to produce an electrical connection between the earth connection conductor track 20 on the substrate 12 and the bent-over section 26 of the flange body 10, so that the earth contact for the RF terminating resistor is made, for example, a solder joint is made from the earth connection conductor track 20 to the bent-over section 26. In that the bent-over section 26 extends in particularly advantageous manner as far as or beyond the upper face 14 of the substrate 12 (second plane), said solder joint can be made easily, quickly and inexpensively in the second plane of the upper face 14 of the substrate 12.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. RF terminating resistor including a flange body and a planar layered structure arranged thereon, comprising: on an upper face of a substrate, a resistor layer for converting RF energy into heat, an input conductor track for supplying RF energy and an earth connection conductor track for electrical connection to an earth contact on the flange body, wherein the input conductor track is electrically connected to a first end of the resistor layer, the earth connection conductor track is electrically connected to a second end of the resistor layer opposing the first end, and the substrate lies on the flange body with a contact face which faces away from the layered structure characterized in that, at a first edge which faces toward the earth connection conductor track on the substrate, over at least one predetermined section in a direction parallel to said edge and a predetermined section in a direction perpendicular to said edge, the flange body is bent over such that a bent-over section of the flange body extends into a space between a first plane defined by the contact face of the substrate and a second plane defined by the upper face of the substrate, wherein, with one side which connects the contact face of the substrate to the upper face of the substrate and towards which the earth connection conductor track on the upper face of the substrate faces, the substrate abuts the bent-over section of the flange body, wherein the bent-over section of the flange body has at least two noses, the separation of which in the direction parallel to the first edge of the flange body correspondsto the width of the substrate, and which extend into a space between the first plane and the second plane.

2. The RF terminating resistor of claim 1, including the bent-over section the flange body rising from the first plane at least into the second plane or therebeyond, such that at least one section of the bent-over section of the flange body extends in the second plane adjacent to the earth connection conductor track.

3. The RF terminating resistor of claim 1, wherein the bent-over section of the flange body includes a length in a direction parallel to the first edge which corresponds to at least a width of the substrate.

4. The RF terminating resistor of claim 1 including the bent-over section enclosing an angle of 90° with the first plane on a side facing toward the substrate.

5. The RF terminating resistor of claim 1 including the bent-over section enclosing an angle with the first plane on a side facing towards the substrate of less than 90°.

6. The RF terminating resistor of claim 1 including an angle in the range of approximately 4° to 10° between the bent-over section of the flange body and a perpendicular to the upper face of the substrate.

7. The RF terminating resistor of claim 2 wherein the bent-over section of the flange body includes a length in a direction parallel to the first edge which corresponds to at least a width of the substrate.

8. The RF terminating resistor of claim 2 including the bent-over section enclosing an angle of 90° with the first plane on a side facing toward the substrate.

9. The RF terminating resistor of claim 3 including the bent-over section enclosing an angle of 90° with the first plane on a side facing toward the substrate.

10. The RF terminating resistor of claim 2 including the bent-over section enclosing an angle with the first plane on a side facing towards the substrate of less than 90°.

11. The RF terminating resistor of claim 3 including the bent-over section enclosing an angle with the first plane on a side facing towards the substrate of less than 90°.

12. The RF terminating resistor of claim 1 including the bent-over section enclosing an angle with the first plane on a side facing towards the substrate of approximately 80° to 86°.

13. The RF terminating resistor of claim 2 including the bent-over section enclosing an angle with the first plane on a side facing towards the substrate of approximately 80° to 86°.

14. The RF terminating resistor of claim 3 including the bent-over section enclosing an angle with the first plane on a side facing towards the substrate of approximately 80° to 86°.

15. The RF terminating resistor of claim 2 including an angle in the range of approximately 4° to 10° between the bent-over section of the flange body and a perpendicular to the upper face of the substrate.

16. The RF terminating resistor of claim 3 including an angle in the range of approximately 4° to 10° between the bent-over section of the flange body and a perpendicular to the upper face of the substrate.

17. The RF terminating resistor of claim 4 including an angle in the range of approximately 4° to 10° between the bent-over section of the flange body and a perpendicular to the upper face of the substrate.

18. The RF terminating resistor of claim 5 including an angle in the range of approximately 4° to 10° between the bent-over section of the flange body and a perpendicular to the upper face of the substrate.

* * * * *